US006861644B2

(12) United States Patent
Miseki

(10) Patent No.: US 6,861,644 B2
(45) Date of Patent: Mar. 1, 2005

(54) ION TRAP MASS SPECTROMETER

(75) Inventor: Kozo Miseki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 210 days.

(21) Appl. No.: 10/170,687

(22) Filed: Jun. 14, 2002

(65) Prior Publication Data

US 2002/0195559 A1 Dec. 26, 2002

(30) Foreign Application Priority Data

Jun. 26, 2001 (JP) ..... 2001-193505

(51) Int. Cl.[7] ..... H01J 49/42

(52) U.S. Cl. ..... 250/282; 250/281; 250/291; 250/292

(58) Field of Search ..... 250/281, 282, 250/291, 292

(56) References Cited

U.S. PATENT DOCUMENTS 5,200,613 A * 4/1993 Kelley ..... 250/282

FOREIGN PATENT DOCUMENTS

JP 2000-323090 11/2000
JP 2001-210268 8/2001

* cited by examiner

*Primary Examiner*—John R. Lee
*Assistant Examiner*—Paul M. Gurzo
(74) *Attorney, Agent, or Firm*—Westerman, Hattori, Daniels & Adrian, LLP

(57) ABSTRACT

In an ion trap mass spectrometer including an ion trap space surrounded by a ring electrode and two end cap electrodes placed opposite each other with the ring electrode between them, a method of trapping object ions of a predetermined mass-to-charge ratio in the ion trap space more assuredly and effectively. The method includes the steps of: applying an RF voltage to the ring electrode to trap the object ions; and applying an auxiliary AC voltage to the end cap electrodes, where the auxiliary voltage has a frequency spectrum with a first notch at the basic frequency of the object ions and a second notch at a a beat frequency. Then the second stage is performed where another auxiliary AC voltage of the beat frequency is applied to the end cap electrodes to expel non-object ions still remaining in the ion trap space.

6 Claims, 4 Drawing Sheets q=0.14 q=0.782

ION TRAP MASS SPECTROMETER

The present invention relates to an ion trap mass spectrometer in which ions are trapped in the ion trap space with an appropriate electric field generated in it.

BACKGROUND OF THE INVENTION

An MS/MS analysis, or tandem analysis, is used with an ion trap mass spectrometer. In the MS/MS analysis, ions having a certain mass-to-charge ratio are selected from an analyzing sample as precursor ions. The selected precursor ions are dissociated with the Collision Induced Dissociation method, and the dissociated ions are mass-analyzed, whereby information on the mass and/or chemical structure of the object ions is obtained.

In normal ion trap mass spectrometers, an ion trap space is formed surrounded by a ring electrode and two end cap electrodes placed opposite each other with the ring electrode between them. The ring electrode has a hyperboloid-of-one-sheet-of-revolution internal surface, and the end cap electrodes have hyperboloid-of-two-sheets-of-revolution internal surfaces. When appropriate voltages are applied between the ring electrode and the end cap electrodes, a quadrupole electric field is generated in the ion trap space, and ions, whichever produced outside and brought inside or produced inside of the ion trap space, are contained, or trapped, in the ion trap space. When an MS/MS analysis is to be conducted, in order to select object precursor ions, the object ions are exclusively selected and left in the ion trap space, and the rest of the ions are discharged from there.

One of the ion selecting methods is as follows. When alternating current (AC) voltages of opposite phases having a certain frequency are applied to the two end cap electrodes, such ions whose secular frequency is the same as the frequency of the AC voltages vibrate resonantly. The amplitude of the resonant vibration increases gradually, and finally the ions escape from the ion trap space or collide with the surrounding electrodes. Thus non-object ions are eliminated and object ions are selectively left in the ion trap space. The mass-to-charge ratio of the ions that vibrate resonantly has a certain relationship with their secular frequency. When a wide band AC voltage having the frequency spectrum, as shown in FIG. 6, which has a notch at frequency $f_0$(i.e., a wide band frequency devoid of the frequency $f_0$) is applied to the end cap electrodes, ions having the mass-to-charge ratio m0 corresponding to the frequency $f_0$ do not vibrate and remain in the ion trap space while other ions vibrate resonantly and are discharged from there. Thus the precursor ions are exclusively selected. Then a buffer gas is introduced to the ion trap space to promote dissociation of the precursor ions due to collisions with the buffer gas molecules. The dissociated ions, called productions, are then discharged from the ion trap space and analyzed.

The vibration frequency of ions in the ion trap space depends on some operating parameters of the ion trap, as well as the mass-to-charge ratio of the ions. For example, it depends on the amplitude of the primary RF voltage applied to the ring electrode. FIG. 7 shows an example of the relationship between the mass-to-charge ratio of an ion and the secular frequency (which corresponds to the notch frequency in an ion selection) of the ion, with the amplitude of the primary RF voltage as a variable parameter. Reference may be made as to the graph to the Publication No. 2000-323090 of Japanese Patent Application filed by the assignee of this application. The slope of the tangent of a curve in FIG. 7 represents the resolution of the mass analysis. When the mass-to-charge ratio is fixed, for example at 200 as shown in FIG. 7, the value of secular frequency, or the notch frequency, increases as the amplitude of the primary RF voltage is increased, and the slope of the tangent deceases as the notch frequency increases, which is apparent comparing the tangents P1 and P2. This means that an increase in the primary RF voltage leads to a higher resolution or an improved selectivity of the mass-to-charge ratio of ions. Thus it is preferable to choose such conditions in an ion selection that the vibrating frequency is higher (by increasing the amplitude of the primary RF voltage, for example) in order to select precursor ions at high resolution.

When precursor ions are selected under the condition that the vibrating frequency is very high with a large amplitude of the primary RF voltage, however, a portion of the precursor ions to be selected is also discharged and less ions remain in the ion trap space, which deteriorates the sensitivity of the overall analysis. That is, in the conventional methods as explained above, the resolution of the mass-to-charge ratio and the sensitivity of the analysis are in a trade-off, so that it was impossible to obtain both at high levels.

SUMMARY OR THE INVENTION

Thus an object of the present invention is to provide an ion trap mass spectrometer in which both the resolution of the mass-to-charge ratio and the sensitivity of the analysis are obtained at high levels in selecting ions in the ion trap space.

The reason why some of the object ions to be trapped are also discharge from the ion trap space when the vibrating frequency of the ions are increased can be explained by the resonating vibration of the ions due to some beat frequency aside from their secular frequency. As the vibrating frequency increases, the vibration due to the beat frequency becomes more than negligible level, and the object ions collide with the electrodes or are discharged from the ion trap space.

Thus the ion trap mass spectrometer according to the present invention includes:

a ring electrode;

an entrance end cap electrode and an exit end cap electrode placed opposite each other with the ring electrode between them forming an ion trap space surrounded by the ring electrode, the entrance end cap electrode and the exit end cap electrode;

a primary RF voltage generator for applying an RF voltage to the ring electrode to trap object ions of a predetermined mass-to-charge ratio;

an auxiliary voltage generator for applying an auxiliary AC voltage to the end cap electrodes; and a voltage controller for controlling the auxiliary voltage generator to apply an auxiliary AC voltage having a frequency spectrum (which is referred to as a "wide band signal" hereinafter) with a first notch at a basic frequency of the object ions and a second notch at a second frequency related to the basic frequency.

Here the "second frequency related to the basic frequency" is the beat frequency generated by the difference between the basic frequency and another frequency.

The ion trap mass spectrometer according to the present invention works as follows. The electric field generated in the ion trap space owing to the auxiliary AC voltage applied to the end cap electrodes includes neither the basic frequency of the object ions nor the beat frequency owing to the two notches. Because the resonant vibrations at such notch frequencies are suppressed, the object ions remain in the ion trap space at high probability. Ions other than the object ions, on the other hand, are incited to vibrate resonantly with the frequencies included in the frequency spectrum. The amplitude of the resonant vibration gradually increases, and the non-object ions collide with the electrode or are discharged from the ion trap space. This brings about an effective selection of the object ions in the ion trap space at high resolution.

When such an auxiliary AC voltage having a frequency spectrum with the two notches is applied to the end cap electrodes, however, non-object ions whose basic frequency is coincidentally the same as the second frequency also remain in the ion trap space with the object ions. Thus, the ion trap spectrometer of the present invention takes the second measures. The voltage controller then makes the auxiliary voltage generator apply another auxiliary AC voltage of the second frequency to the end cap electrodes. Owing to the application of the voltage, only the non-object ions vibrate resonantly and escape from the ion trap space while the object ions are left there.

The wide band signal having a notch or notches at certain frequencies described above can be made by superposing several or many sinusoidal signals of different frequencies. Alternatively, such a signal may be made by the method described in the Publication No. P2001-210268 of Japanese Patent Application filed by the assignee of this application, which was also filed in the United States Patent and Trademark Office and given Ser. No. 09/769,483.

Owing to the ion trap mass spectrometer of the present invention, when object ions having a desired mass-to-charge ratio are to be selected and to be trapped in the ion trap space, the resonant vibration of the ions are adequately avoided. This assures more object ions left and trapped in the ion trap space. When an MS/MS analysis is subsequently conducted, for example, the number of object ions is maximized and so the sensitivity of the analysis is improved.

DETAIL DESCRIPTION OF A PREFERRED EMBODIMENT

Figure 2:
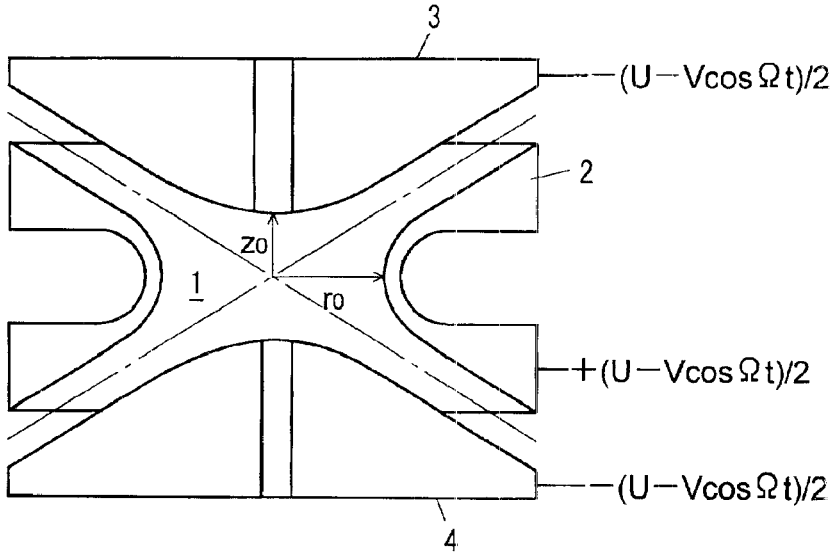
FIG. 2 is a vertical cross sectional view of an ion trap mass spectrometer with the cylindrical coordinate system.

The principles of the ion selecting method according to the present invention is first described. FIG. 2 illustrates a typical ion trap mass spectrometer, in which a cylindrical coordinate system is defined with the z axis penetrating the center of the two end cap electrodes 3, 4.

The ion trap space 1 is defined by the space surrounded by the ring electrode 2 and the two end cap electrodes 3, 4 opposing each other with the ring electrode 2 between them. The ring electrode 2 has a hyperboloid-of-one-sheet-of-revolution internal surface, and the end cap electrodes 3, 4 have hyperboloid-of-two-sheets-of-revolution internal surfaces. A combination of a DC voltage and an RF voltage +(U−V cos Ωt)/2 is applied to the ring electrode 2 and another DC+RF voltage −(U−V cos Ωt)/2 is applied to the end cap electrodes 3, 4.

The vibration of the ions in the ion trap space 1 caused by the quadrupole electric field generated there by the voltages is described by the following equations.

$$d^2r/dt^2+(e/mr_0^2)(U-V\cos\Omega t)r=0, \quad (1) \text{ and}$$

$$d^2z/dt^2+(2e/mr_0^2)U-V\cos\Omega t)z=0, \quad (2)$$

where m is the mass of an ion and e is the electrical charge of the ion.

Using parameters $a_z$, $a_r$, $q_z$ and $q_r$, as defined by equations (3) and (4), the above equations of motion are rewritten in the Mathieu equations as shown by (5) and (6).

$$a_z=-2a_r=(-8eU)/(mr_0^2\Omega^2), \quad (3)$$

$$q_z=-2q_r=(-4eU)/(mr_0^2\Omega^2), \quad (4)$$

$$d^2r/d\zeta^2+(a_r-2q_r\cos 2\zeta)r=0, \quad (5) \text{ and}$$

$$d^2z/d\zeta^2+(a_z-2q_z\cos 2\zeta)z=0, \quad (6)$$

where $\zeta=(\Omega t)/2$.

Figure 3:
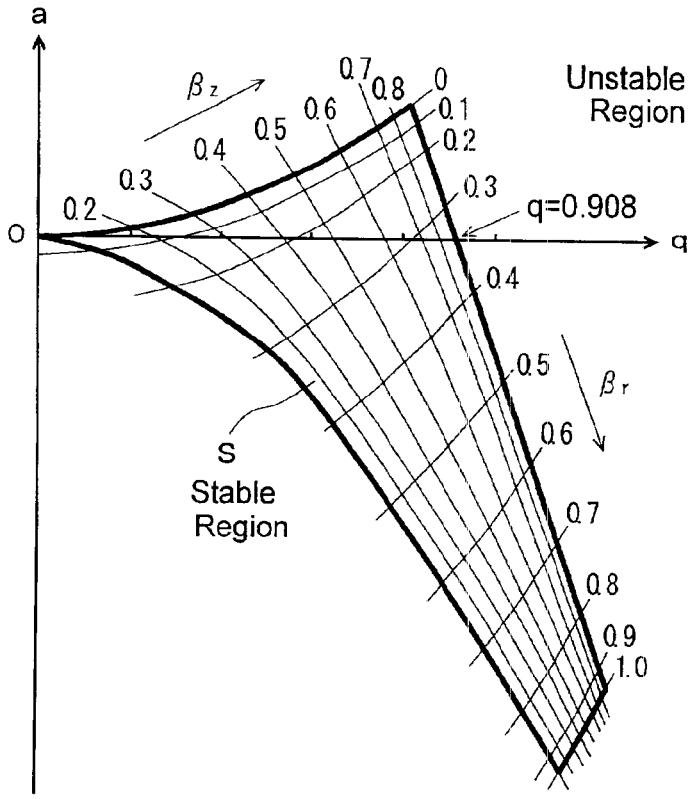
FIG. 3 is a graph showing the stable region of ions in the space of parameters relating to the ion trap space.

The characteristics of the solution of the Mathieu equations can be described by using $a_z$ and $q_z$. FIG. 3 illustrates the stable conditions of the solution of the Mathieu equations with $a_z$ as the ordinate and $q_z$, as the abscissa. The region S surrounded by the thick lines in the $a_z$-$q_z$ plane represents the stable solution of the above Mathieu equations. Since the parameters $a_z$ and $q_z$ are defined by the mass-to-charge ratio (m/e) of the ions, ions whose mass-to-charge ratio corresponds to the parameters ($a_z$, $q_z$) falling within the stable region S vibrate stably at a certain frequency and can be trapped in the ion trap space 1. Thus the stable region S represents the condition that ions can be stably trapped in the ion trap space 1, and the region outside S is the unstable region. In FIG. 3, β is a parameter derivable from the parameter q.

The ions trapped in the ion trap space 1 vibrate as described by the following formula.

$$\alpha_1\Sigma C_{2n}\cos(2n\pm\beta)\zeta+\alpha_2\Sigma C_{2n}\sin(2n\pm\beta)\zeta \quad (7)$$

The formula (7) means that the vibration is a superposition of the vibrations of frequencies $\omega_n=(2n\pm\beta)\zeta$. Generally, the vibration is approximated by the basic frequency $\omega_0$ which is obtained by substituting 0 to n.

Since ion trap mass spectrometers are normally used with U=0, or a=0, the following explanation is based on this supposition. When a certain constant voltage V is applied to the ring electrode 2, the value of q in the stable region S depends on the mass m, as is apparent in the definition of (4). FIG. 3 shows that different $q_z$ means different $\beta_z$. Thus, when the constant voltage V is applied to the ring electrode 2, ions of various mass m vibrate with various frequencies in the ion trap space 1 depending on their mass m. The frequency of the vibration is higher in lighter ions (or ions with smaller m), and is lower in heavier ions (or ions with larger m).

Figure 7:
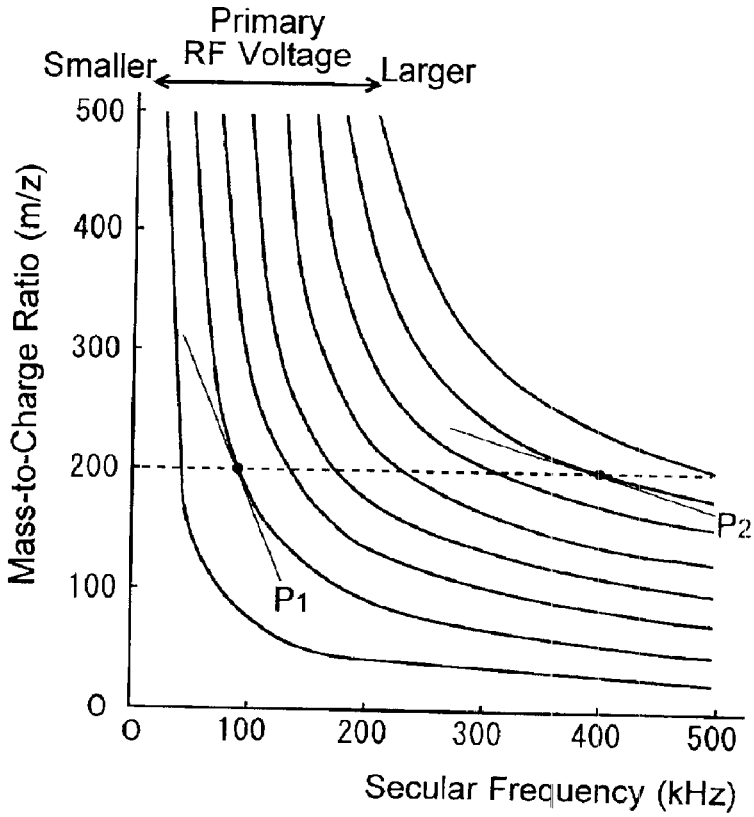
FIG. 7 is a graph of the relationship between the mass-to-charge ratio of an ion and the secular frequency of the ion with the amplitude of the primary RF voltage as a variable parameter.

In order to discharge ions of a certain mass-to-charge ratio among various ions trapped in the ion trap space 1, as described before, an AC voltage having such frequency that the ions of the mass-to-charge ratio resonate is applied to the end cap electrodes 3, 4. That is, in the precursor ion selecting process in which ions of a certain mass-to-charge ratio are left in the ion trap space 1 and the rest of the ions are discharged from there, a wide band AC voltage having a notch at the frequency corresponding to the mass-to-charge ratio of the ions to be left is applied to the end cap electrodes 3, 4. As is apparent from FIG. 3, on the line $a_z=0$ in the stable region S, the difference in β corresponding to a difference in $q_z$ increases as the value of $q_z$ increases. In other words, the mass resolution (or mass selectivity) in the precursor ion selecting process is higher as the value of $q_z$ is larger. This coincides with the graph of FIG. 7.

Figure 5A:
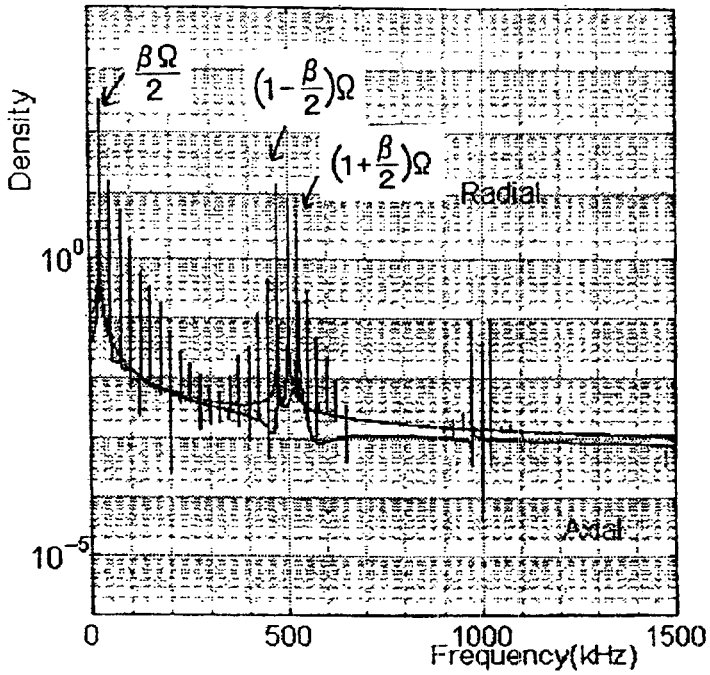
FIG. 5A is a graph of the frequency spectrum of the vibration of the ions with q=0.14.
Figure 5B:
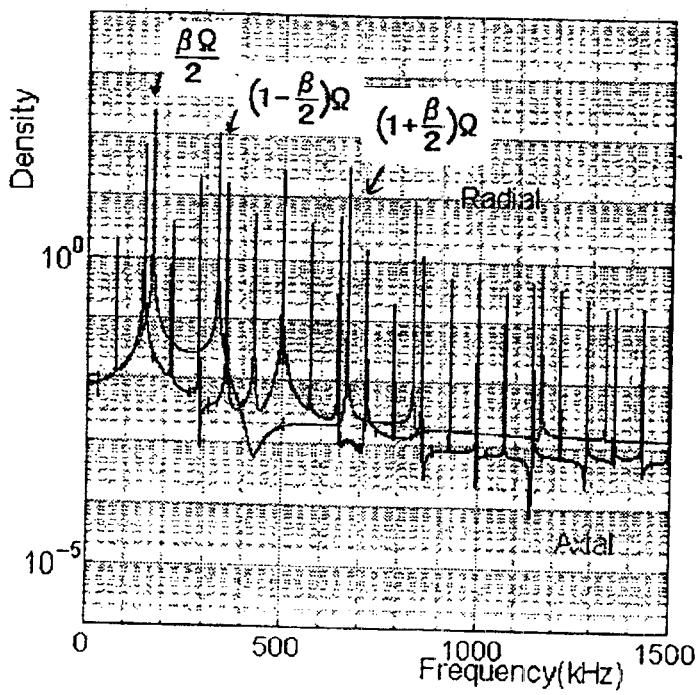
FIG. 5B is another graph with q=0.782, both obtained from computer simulation.
Figure 6:
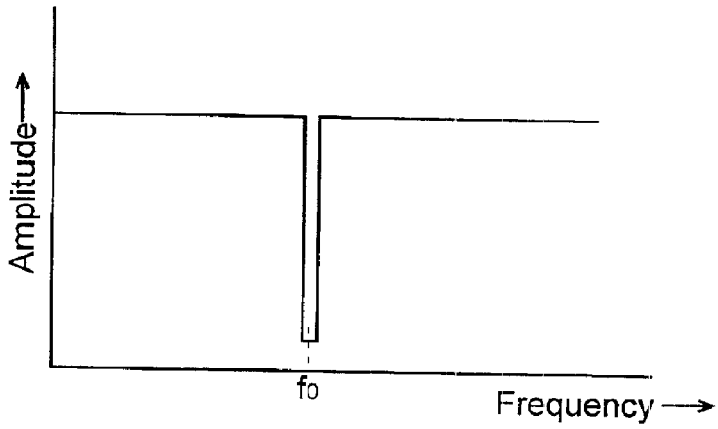
FIG. 6 shows an example of the frequency spectrum of a wide band signal for the auxiliary AC voltage used in a conventional ion trap mass spectrometer.

As explained before, the vibration of ions can be approximated by the vibration of the basic frequency as shown by the formula (7) with n=0. In fact, such an approximation is possible only when the value q is relatively small. FIG. 5 shows the frequency spectrum of the vibration of ions obtained from computer simulation. The graph of FIG. 5A shows the result at q=0.14, and that of FIG. 5B shows the result at q=0.782. As seen in the graphs, when q=0.14, the strength of the frequency component higher than the basic frequency $\omega_0$ is less than 1/10 of that of the basic frequency $\omega_0$. But, when q=0.782, the ratio in the strength of frequency component higher than the basic frequency $\omega_0$ is larger. For example, the strength of the frequency $\omega_1=(1-\beta/2\Omega$, where n=1, is about ½ of that of the basic frequency $\omega_0=(\beta/2)\Omega$.

As seen from FIG. 2, the value of β can take from 0 to 1. The maximum value of the vibrating frequency of the ions is, therefore, not larger than ½ of a primary AC voltage, and the basic frequency $\omega_0$ is the lowest frequency of the vibrating component of the ions. The lowest frequency component next to the basic frequency is $(1-\beta/2)\Omega$, which is no smaller than $(\beta/2)\Omega$ because β does not exceed 1. Thus, the value of $(1-\beta/2)\Omega$ does not overlap the frequencies in the stable region S, so that, even if such frequency component is included, ions in the stable region S are not excited undesirably and the ions are not discharged.

When, however, plural frequency components are mixed, a beat or beats corresponding to the difference or differences of the frequencies. As shown in FIG. 5B, when the value of q is large, the amplitude of the resonant vibration of ions increases as the frequency component of $(1-\beta/2)\Omega$ increases. In such a case, the beat frequency is $(1-\beta)\Omega$, which overlaps the frequencies in the stable region S. If such a frequency component exists in selecting precursor ions, the amplitude of the beat vibration of the ions gradually increases, and, in the end, the ions collide with the electrodes or are discharged from the ion trap space.

According to the ion trap mass spectrometer of the present invention, precursor ions are selected, or in other words, ions other than the selected ions are discharged from the ion trap space, as follows.

After various ions are trapped with the quadrupole electric field in the ion trap space 1, as the first stage, an auxiliary AC voltage on a wide band signal ("wide band AC voltage") is applied to the end cap electrodes 3, 4, where the wide band AC voltage has notches at two places. One of the notches is at $(\beta/2)\Omega$ which corresponds to the basic frequency of the object precursor ions, and the other is at $(1-\beta)\Omega$ which corresponds to the beat frequency. Owing to this, the precursor ions vibrate neither at the basic frequency nor at the beat frequency, so that the precursor ions are certainly kept in the ion trap space.

Almost all ions other than the precursor ions do not remain in the ion trap space because they vibrate resonantly with the wide band AC voltage, and collide with the electrodes or are discharged from there. But some ions, other than the precursor ions, whose basic frequency is the same as the beat frequency $(1-\beta)\Omega$ do not vibrate because the wide band AC voltage has a notch at the beat frequency $(1-\beta)\Omega$. Though these ions may vibrate with a small amplitude due to a beat frequency to these ions, these ions are likely to remain in the ion trap space 1.

So the second stage is performed, where an auxiliary AC voltage of a single frequency of $(1-\beta)\Omega$ is applied to the end cap electrodes 3, 4. As described above, the frequency is the basic frequency of the non-object ions that remain in the ion trap space 1 together with the object precursor ions. Owing to the application of such an auxiliary AC voltage, the non-object ions vibrate resonantly in the electric field generated by the auxiliary AC voltage, and the amplitude of the vibration gradually increases until the non-object ions collide with the electrodes or they are discharged from the ion trap space 1. Since the frequency is single, no beat occurs, and the object precursor ions are not affected by the electric field but remain in the ion trap space 1.

Owing to the two-stage process, non-object ions are almost certainly discharged from the ion trap space 1 without losing the object precursor ions. Molecules of a buffer gas, He for example, introduced from outside into the ion trap space 1 are dashed against the precursor ions thus selected to promote dissociation of the precursor ions. The fragment ions produced by the dissociation are mass analyzed to obtain information of the mass and the chemical structure of the object ions.

Figure 1:
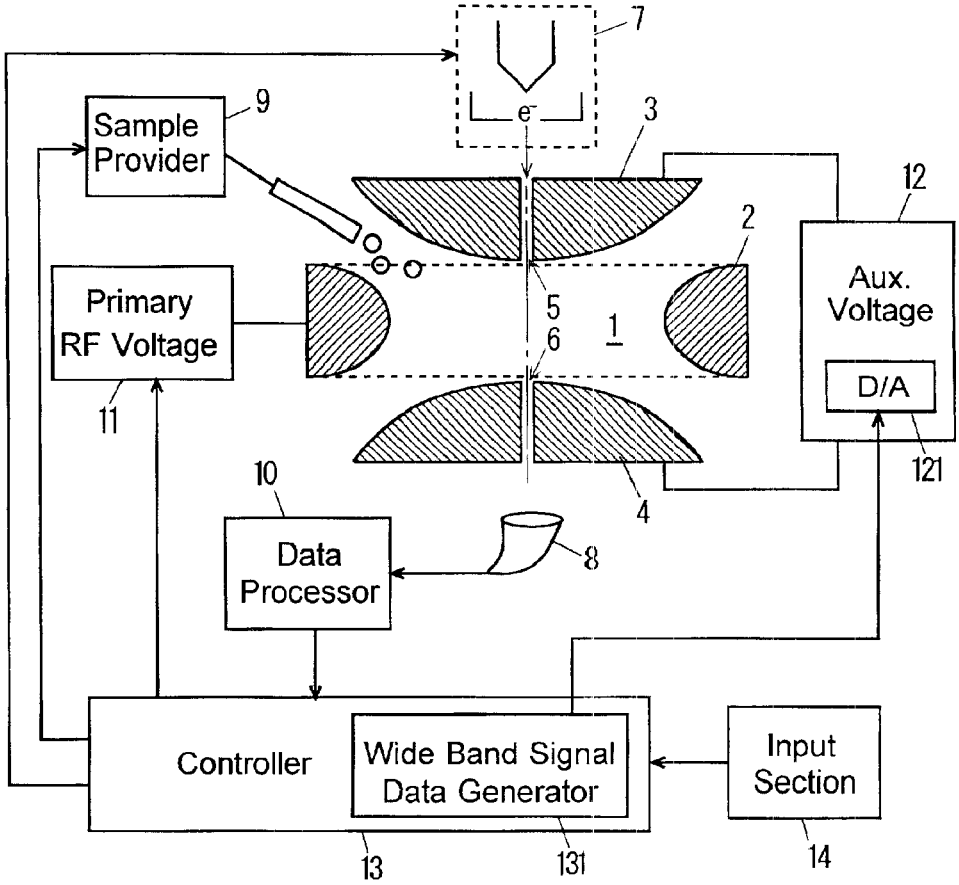
FIG. 1 shows a schematic construction of an ion trap mass spectrometer embodying the present invention.

FIG. 1 shows an embodiment of the ion trap mass spectrometer of the present invention. The peripheral elements of the ion trap space 1 are the same as those in FIG. 2, so that the corresponding explanation can be referred to there when necessary.

As shown in FIG. 1, the ring electrode 2 is connected to a primary RF voltage generator 11, and the two end cap electrodes 3, 4 are connected to an auxiliary voltage generator 12. A thermal electron generator 7 is provided outside of the entrance hole 5 which is formed at almost the center of the entrance end cap electrode 3. The thermal electrons generated by the thermal electron generator 7 pass through the entrance hole 5 and enter the ion trap space 1. The thermal electrons collide with molecules of a sample introduced from a sample provider 9, and ionize the molecules. An ion detector 8 is provided at just outside of the exit hole 6 which is aligned with the entrance hole 5. The ion detector 8 detects ions ejected from the ion trap space 1 through the exit hole 6, and produces an electrical signal corresponding to the number of detected ions. The electrical signal is sent to the data processor 10.

The primary RF voltage generator 11 and the auxiliary voltage generator 12 receive control signals from the controller 13, by which they are controlled to generate AC voltages of given frequencies and given amplitudes. The controller 13 is made of a computer including CPU, ROM, RAM and other peripheral devices, and sends the control signals to the above described voltage generators 11, 12 based on the conditions set on the input section 14. The controller 13 includes the function of a wide band signal data generator 131. The wide band signal data generator 131 generates digital data for composing a wide band signal having a notch or notches at a certain frequency or frequencies based on the conditions set on the input section 14. The digital data is sent to the auxiliary voltage generator 12, which converts the digital data into an analog signal with the D/A converter, and applies a voltage corresponding to the analog signal to the end cap electrodes 3, 4.

In the wide band signal data generator 131, any desired wide band signal is made by, for example, superposing many sinusoidal waves of various frequencies. The method is described in detail in the above-described Publication No. P2001-210268 of Japanese Patent Application.

The operation of the ion trap mass spectrometer when ions of a certain mass-to-charge ratio is analyzed in the MS/MS mode is then described. First the operator uses the input section 14 to set the mass-to-charge ratio of the precursor ions to be analyzed. Based on the set mass-to-charge ratio and some predetermined parameters of the mass spectrometer including the resolution of the mass analysis, the controller 13 calculates the first notch frequency, which corresponds to the basic frequency of the precursor ions, and the second notch frequency, which corresponds to the beat frequency. The calculation can be conducted using predetermined formulae, or it can be replaced by using a preset reference tables stored in the ROM.

The action of the mass spectrometer before it traps various ions including the precursor ions in the ion trap space 1 is the same as that of conventional ones. That is, sample molecules are introduced from the sample provider 9 into the ion trap space 1, and thermal electrons generated by the thermal electron generator 7 are also introduced there, where they contact each other and the sample molecules are ionized. The ions are contained in the ion trap space 1 owing to the quadrupole electric field generated by the primary RF voltage applied to the ring electrode 2 by the primary RF voltage generator 11.

Figure 4A:
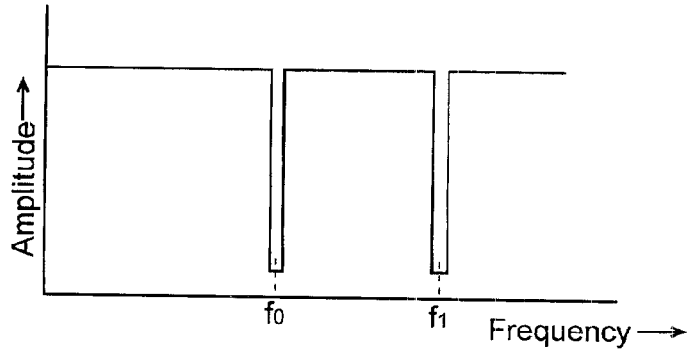
FIGS. 4A and 4B show examples of the frequency spectra of the wide band signal and the single frequency signal for the auxiliary AC voltage used in the ion trap mass spectrometer of the embodiment.

Then the wide band signal data generator 131 generates data for producing a wide band signal having two notches as described above, and sends it to the auxiliary voltage generator 12. The auxiliary voltage generator 12 converts the data with the D/A converter 121 to an analog signal, and applies the analog signal to the end cap electrodes 3, 4. The spectrum of the applied voltage has, as shown in FIG. 4A, two notches at $f_0$ and $f_1$. Owing to the wide band AC voltage, only the precursor ions having the preset frequency do not resonate with the voltage, and remain in the ion trap space 1, while other ions vibrate resonantly and the vibration amplitude gradually increases, so that they collide with the electrodes or are discharged externally through the exit hole 6.

Figure 4B:
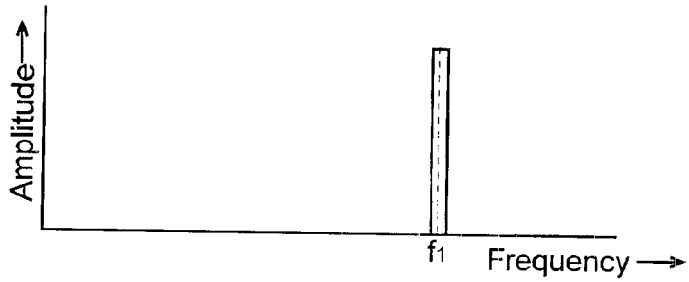

After leaving the object precursor ions in the ion trap space 1, the wide band signal data generator 131 generates data for producing a single frequency signal of the beat frequency $f_1$, and sends the data to the auxiliary voltage generator 12. The auxiliary voltage generator 12 converts the data with the D/A converter to an analog signal, and applies the signal to the end cap electrodes 3, 4. The spectrum of the applied voltage has a single frequency, $f_1$ for example, as shown in FIG. 4B. Owing to the signal, non-object ions, which have the basic frequency of $f_1$ and so did not resonate when the wide band frequency signal was applied having a notch at $f_1$, vibrate resonantly this time, and collide with the electrodes or are discharged from the ion trap space 1.

Thus only the object precursor ions remain in the ion trap space 1. By introducing, then, molecules of a buffer gas through a buffer gas pipe (not shown) in the ion trap space, the buffer gas molecules collide with the precursor ions so that the precursor ions are dissociated to produce various fragment ions.

As described before, the ion selectivity (or the ion selecting efficiency) normally deteriorates as the selecting frequency becomes high. In contrast, the selectivity (or selecting resolution) of the precursor ions is high in present invention. In that sense, the present invention is especially effective in such cases where ions are selected at high frequencies. But the efficiency of the present invention is not so high in other cases. Thus, it is better to use the present invention where it is effective, and use a conventional method otherwise.

Of course the above description is only a mere embodiment of the present invention, and it is apparent to those skilled in the art to modify various peripherals without leaving the gist of the present invention.

What is claimed is:

1. An ion trap mass spectrometer comprising:

a ring electrode;

an entrance end cap electrode and an exit end cap electrode placed opposite each other with the ring electrode between them forming an ion trap space surrounded by the ring electrode, the entrance end cap electrode and the exit end cap electrode;

a primary RF voltage generator for applying an RF voltage to the ring electrode to trap object ions of a predetermined mass-to-charge ratio;

an auxiliary voltage generator for applying an auxiliary AC voltage to the end cap electrodes; and a voltage controller for controlling the auxiliary voltage generator to apply an auxiliary AC voltage having a frequency spectrum with a first notch at a basic frequency of the object ions and a second notch at a frequency equal to a beat between the basic frequency and another frequency.

2. The ion trap mass spectrometer according to claim 1, wherein the voltage controller then controls the auxiliary voltage generator to apply an auxiliary AC voltage of the second frequency to the end cap electrodes.

3. The ion trap mass spectrometer according to claim 1, wherein the voltage controller then controls the auxiliary voltage generator to apply an auxiliary AC voltage of the second frequency to the end cap electrodes.

4. In an ion trap mass spectrometer, a method of trapping object ions of a predetermined mass-to-charge ratio in an ion trap space surrounded by a ring electrode and two end cap electrodes placed opposite each other with the ring electrode therebetween, the method comprising steps of:

applying an RF voltage to the ring electrode to trap the object ions;

applying an auxiliary AC voltage to the end cap electrodes, the auxiliary voltage having a frequency spectrum with a first notch at a basic frequency of the object ions and a second notch at a frequency equal to a beat betwwen the basic frequency and another frequency.

5. The ion trapping method according to claim 4, wherein, after the auxiliary AC voltage is applied, another auxiliary AC voltage of the second frequency is applied to the end cap electrodes.

6. The ion trapping method according to claim 4, wherein, after the auxiliary AC voltage is applied, another auxiliary AC voltage of the second frequency is applied to the end cap electrodes.

* * * * *